US008028861B2

(12) United States Patent
Brouwer

(10) Patent No.: US 8,028,861 B2
(45) Date of Patent: Oct. 4, 2011

(54) DISPENSER WITH IMPROVED SUPPLY-CLOSING MEANS

(75) Inventor: Markus Franciskus Brouwer, Heesch (NL)

(73) Assignee: MeadWestvaco Calmar Netherlands B.V., Richmond, VA (US)

( * ) Notice: Subject to any disclaimer, the term of this patent is extended or adjusted under 35 U.S.C. 154(b) by 834 days.

(21) Appl. No.: 11/911,950

(22) PCT Filed: Apr. 20, 2006

(86) PCT No.: PCT/NL2006/000208

§ 371 (c)(1),
(2), (4) Date: Mar. 26, 2008

(87) PCT Pub. No.: WO2006/112704

PCT Pub. Date: Oct. 26, 2006

(65) Prior Publication Data

US 2009/0212074 A1 Aug. 27, 2009

(30) Foreign Application Priority Data

Apr. 20, 2005 (NL) ..... 1028826
Sep. 26, 2005 (NL) ..... 1030030

(51) Int. Cl.
*B67D 5/00* (2006.01)

(52) U.S. Cl. ..... 222/190; 222/1; 222/321.7; 222/383.1

(58) Field of Classification Search ..... 222/190, 222/1, 321.7–321.9, 383.1
See application file for complete search history.

(56) References Cited

U.S. PATENT DOCUMENTS

| | | | | |
|---|---|---|---|---|
| 3,369,757 | A | 2/1968 | Boris | |
| 4,932,567 | A * | 6/1990 | Tanabe et al. | 222/190 |
| 5,289,952 | A | 3/1994 | Gueret et al. | |
| 6,536,629 | B2 * | 3/2003 | van der Heijden | 222/190 |
| 6,612,468 | B2 * | 9/2003 | Pritchett et al. | 222/190 |
| 7,048,153 | B2 * | 5/2006 | Gentile | 222/190 |
| 7,275,661 | B2 * | 10/2007 | Iizuka et al. | 222/145.6 |
| 7,461,762 | B2 * | 12/2008 | Law et al. | 222/190 |
| 7,802,701 | B2 * | 9/2010 | Jahan et al. | 222/153.13 |
| 7,823,751 | B2 * | 11/2010 | Ophardt et al. | 222/137 |
| 2002/0056730 | A1 * | 5/2002 | van de Heijden | 222/190 |
| 2003/0015552 | A1 * | 1/2003 | Bistolfi | 222/145.6 |
| 2005/0006408 | A1 * | 1/2005 | Ganzeboom | 222/190 |
| 2005/0029302 | A1 * | 2/2005 | Iizuka et al. | 222/190 |
| 2006/0151538 | A1 * | 7/2006 | Van Der Heijden | 222/190 |
| 2007/0151985 | A1 * | 7/2007 | Iizuka et al. | 222/190 |

FOREIGN PATENT DOCUMENTS

| | | | |
|---|---|---|---|
| EP | 0 613 728 | A | 9/1994 |
| EP | 1 190 775 | A | 3/2002 |
| WO | 02/42005 | A1 | 5/2002 |
| WO | 2004/069418 | A1 | 8/2004 |
| WO | WO 2006/112701 | | 10/2006 |

* cited by examiner

*Primary Examiner* — Frederick C Nicolas
*Assistant Examiner* — Donnell Long
(74) *Attorney, Agent, or Firm* — MWV Intellectual Property Group

(57) ABSTRACT

The invention relates to a dispenser, particularly suitable for a liquid container, comprising: an air pump with an air cylinder (23) and an air piston (3) axially displaceable in the air cylinder, an air space (19) defined between the air cylinder and the air piston, supply-closing means (39) for closing the air supply to the air pump, discharge-closing means for closing the air discharge from the air pump, a cover (1) connected to the air piston, an air inlet opening (12) in the cover, wherein the air inlet opening debouches directly into the air space, and an annular element (39) which extends axially on the inside of the cover and which comprises an edge part, which edge part is in contact with at least the part of the inner wall of the cover located around the air inlet opening (12).

18 Claims, 7 Drawing Sheets

DISPENSER WITH IMPROVED SUPPLY-CLOSING MEANS

The present invention relates to a dispenser, particularly suitable for a liquid container, comprising an air pump with an air cylinder and an air piston, wherein an air chamber is defined between the air cylinder and the air piston, supply-closing means for closing the air supply to the air pump, and discharge-closing means for closing the air discharge from the air pump.

Such a dispenser is known from WO 02/42005 and WO 2004/069418. The dispensers shown herein form the basis for the present invention. The content of these applications are therefore incorporated herein by means of explicit reference.

In this known dispenser is provided a cover with a spout-like dispensing part which is received slidably in a base part. The base part is clicked onto a liquid container or screwed onto the neck of a liquid container by means of a separate threaded ring. Placed in the cover is an insert which is provided on its bottom end with a dish-shaped flexible edge part which co-acts with a peripheral edge on the inside of the cover. An air chamber is located between the axially displaceable cover and the base part. The edge part formed on the insert forms therewith the inlet valve for admitting air into the air chamber. The peripheral edge on the inside of the cover herein serves as seating. The insert further forms a mixing chamber in which the air and liquid come together and, together with the cover, forms an outflow passage to the spout-like dispensing part. The dispenser is further also provided with a liquid pump for pumping liquid upward from the liquid container, and the outlet of the liquid pump is in communication with the mixing chamber. In the mixing chamber liquid from the liquid pump is mixed with air from the air pump.

The manufacture of the edge part on the insert requires relatively great precision for good operation of the air pump. The present invention therefore has for its object to provide an improved dispenser which is simpler to manufacture.

A dispenser as described and shown herein is provided for this purpose. An opening is provided in the cover by means of which air enters the dispenser. Directly adjacent to and in contact with the (edge round the) opening in the cover are arranged supply-closing means. In this manner air will be drawn directly from the environment into the air chamber of the air pump through the opening in the cover. The supply-closing means preferably comprise an annular element which is placed on the inside of the cover against the inner wall thereof. This annular element has a wall part of which at least the bottom edge is yielding and co-acts with the inner wall of the cover serving as seating. In addition, the annular element has an inner edge part with which the annular element is fixed on the insert. The annular element is hereby positioned between the cover and the insert.

The invention will be further elucidated with reference to the accompanying drawings. In the drawings.

Figure 1:
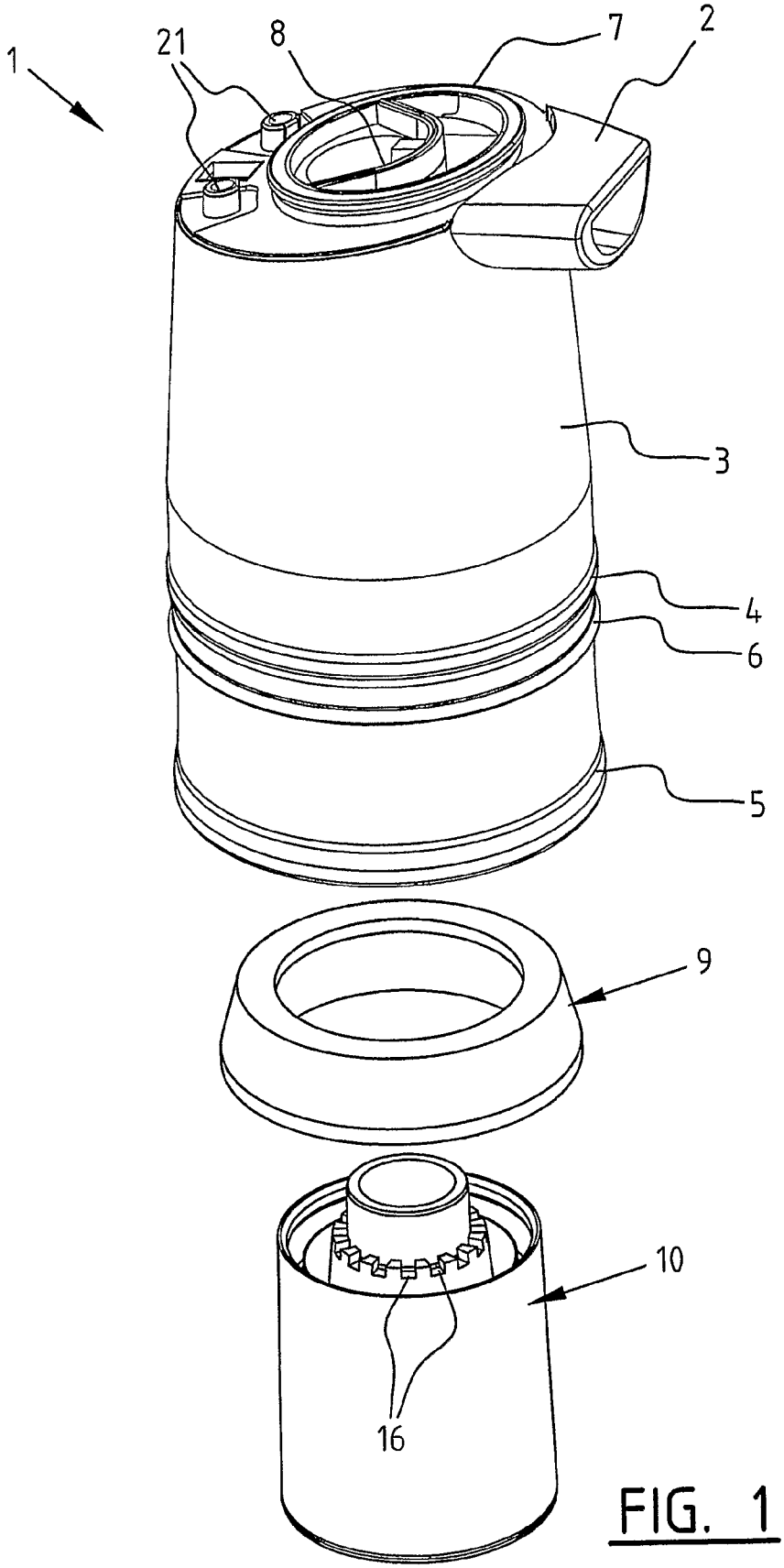
FIG. 1 shows a part of the dispenser according to the present invention with exploded parts.

The drawings do not show the whole dispenser. Explicit reference is made for this purpose to the figures of WO 02/42005 and WO 2004/069418. Explicit reference is likewise made to the associated description for a description of the complete dispenser and its function.

Reference numeral 1 designates the cover which is provided with a spout-like dispenser 2 and a casing 3. Casing 3 is designed on the underside as a piston for the air pump. The piston comprises two peripheral edges 4,5 and a peripheral lip 6 lying therebetween. With protruding edges 4,5 the cover 1 is in contact with the inner wall of the base part (not further shown here) of the dispenser. Peripheral lip 6 forms a seal. On the top side of cover 1 can further be seen two channel-like openings 21, by means of which air has been drawn beforehand from the environment into the dispenser. An annular support edge 7 with partition wall 8 can also be seen on the top side of cover 1. On support edge 7 a foam-forming element is placed in contact with partition wall 8. The product for dispensing passes through this foam-forming element twice on the way to spout-like dispensing part 2. A cover member forming an engaging surface for operating the dispenser is arranged on top of cover 1, over support edge 7 and partition wall 8.

Reference numeral 9 designates an annular element which forms the supply-closing means for the air pump.

Finally, reference numeral 10 in FIG. 1 designates an insert. This insert is practically identical to the insert of WO 2004/069418, with the understanding that the bottom end thereof is not provided with a dish-like valve as was previously the case.

Figure 3:
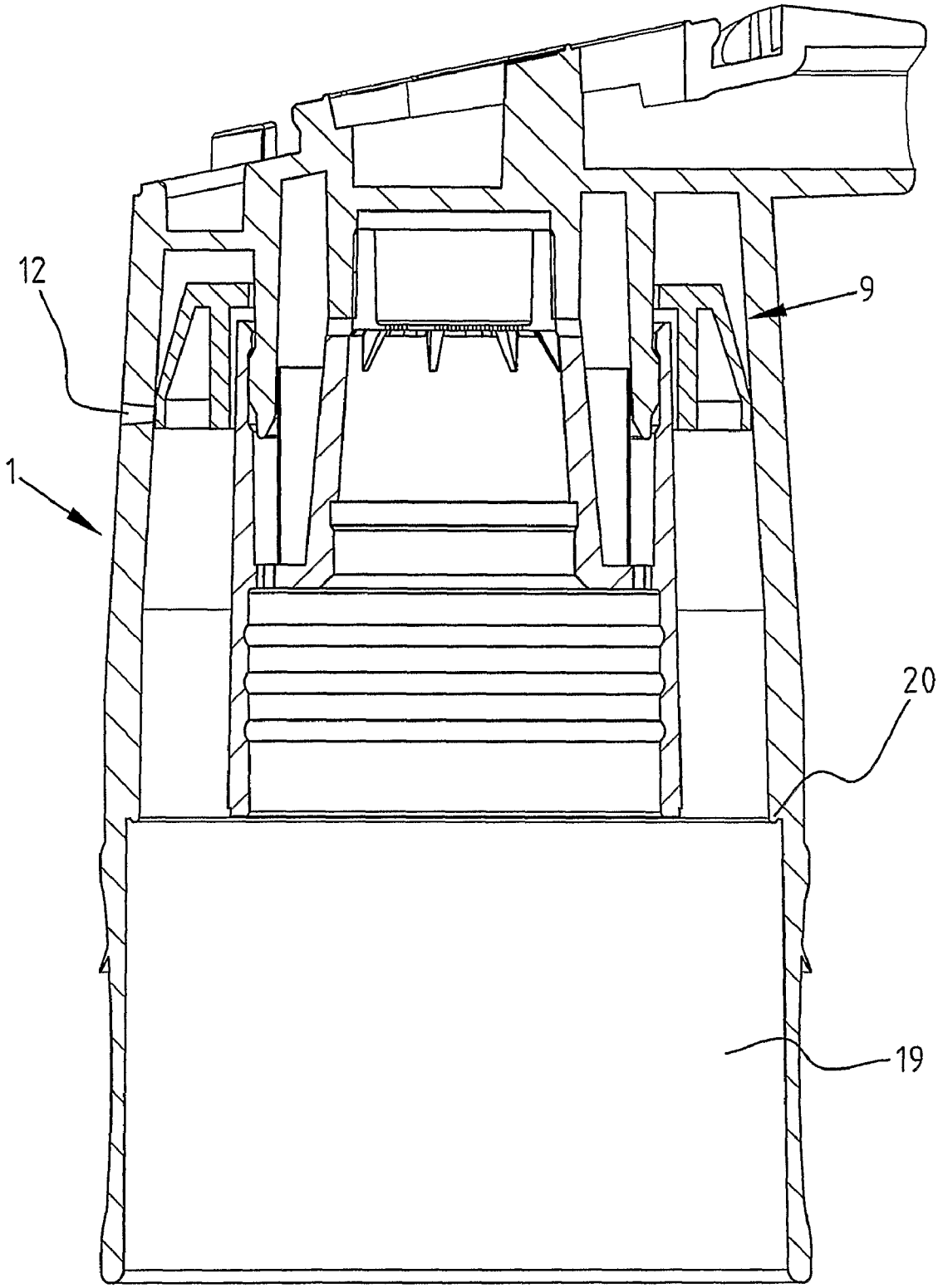
FIG. 3 shows the assembled dispenser of FIG. 1 in cross-section.
Figure 4:
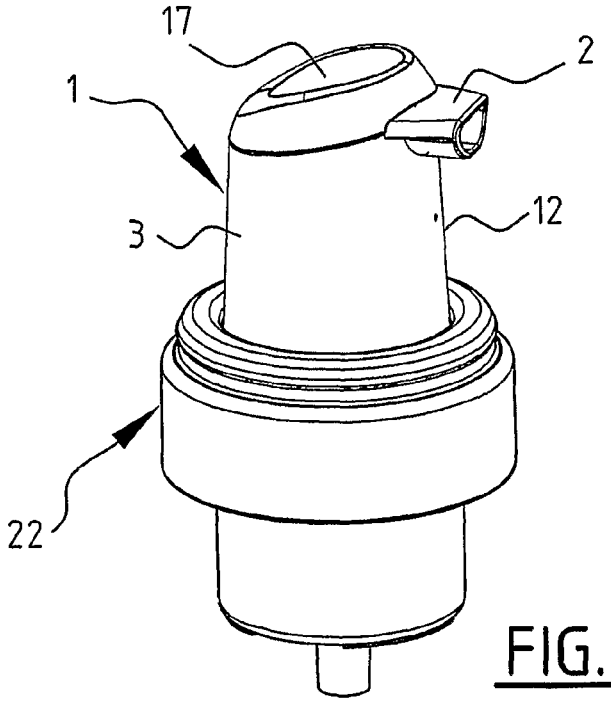
FIGS. 4-6 show another example of a dispenser shown respectively in perspective, cross-section and with exploded parts.
Figure 5:
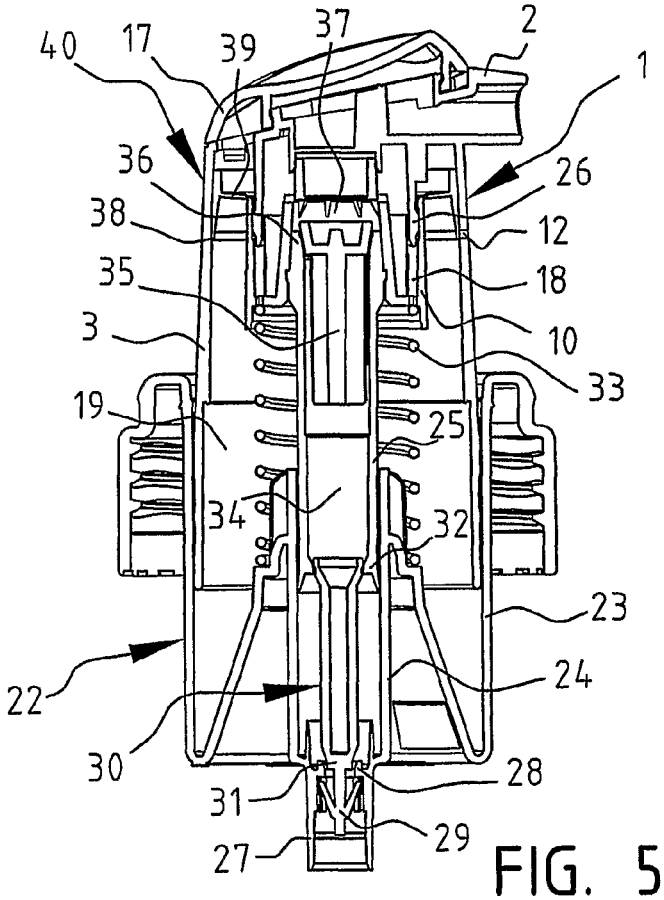
Figure 6:
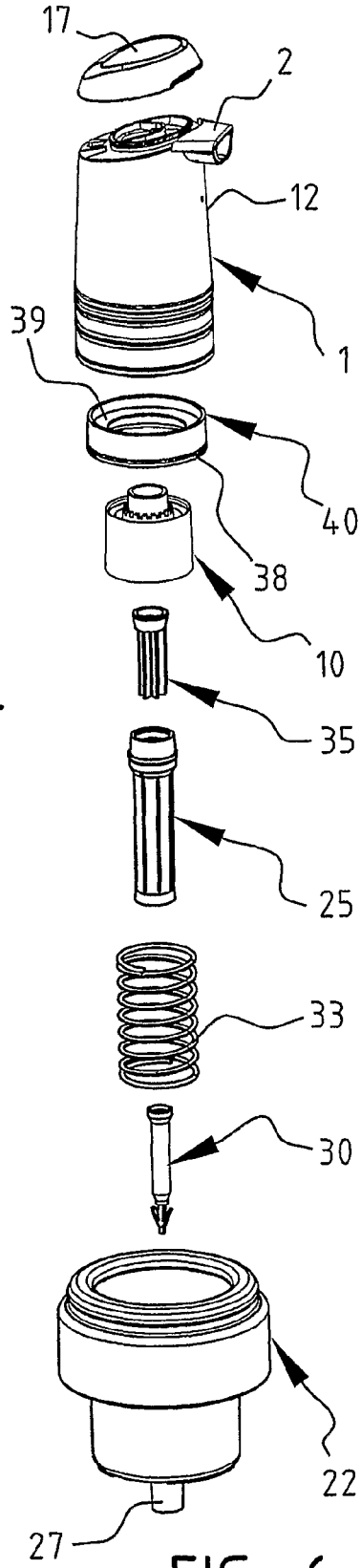

Annular element 9 is placed on insert 10 and this assembly is then mounted in cover 1. The position according to FIG. 3 is then obtained.

Figure 2:
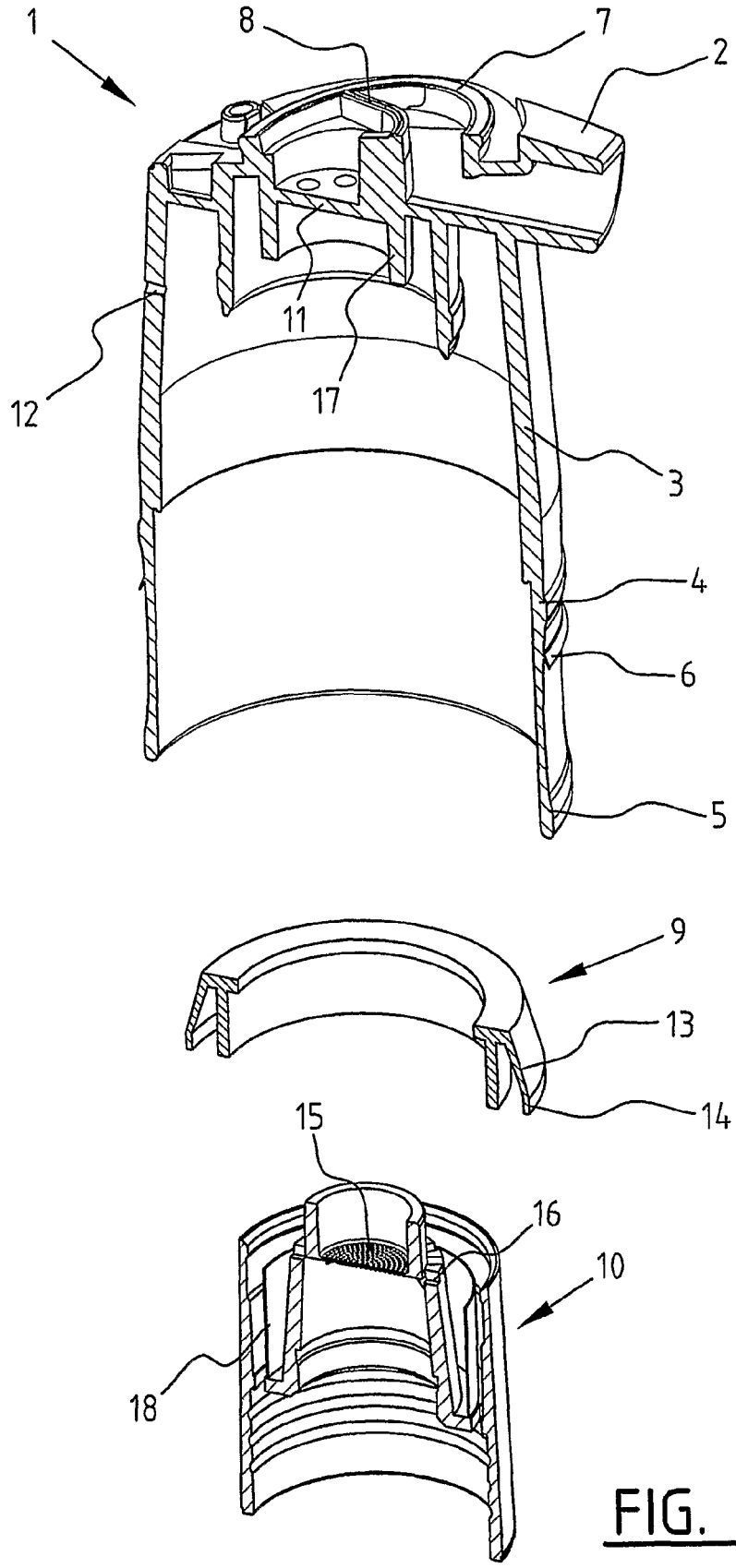
FIG. 2 shows the dispenser depicted in FIG. 1 in cross-sectional perspective view.

FIG. 2 shows the components of FIG. 1 in cross-sectional perspective view. It can now be seen that a second foam-forming element 11 is provided on the top side of cover 1. In addition, an air inlet opening 12 is arranged in casing 3 of cover 1. Air will enter the dispenser through this opening 12. Openings 21 in the upper wall of cover 1 can hereby be omitted.

FIG. 2 further shows the cross-sectional form of an annular element 9. Element 9 consists of a substantially T-shaped body with a wall part 13 which is formed thereon and which extends substantially obliquely downward. The bottom edge 14 of this wall part 13 eventually comes to lie over air inlet opening 12 in cover 1. Wall part 13 can pivot relative to the T-shaped part due to pressure difference between the air chamber and the environment. Depending on the pressure difference, air opening 12 can hereby be covered or be left clear by air inlet valve 9.

The cross-sectional view of insert 10 shows a further foam-forming element 15 which forms the upper wall of the mixing chamber. Passages 16 are situated around this foam-forming element 15 and just below it (see also FIG. 1) for the supply of air from the air pump to the mixing chamber. A thin-walled flexible upright edge part 18 is further formed on insert 10 and serves as discharge-closing means for the air pump.

FIG. 3 shows a part of the dispenser according to the invention in cross-section. A liquid pump and base part in which the assembly shown in FIG. 3 is axially displaceable is absent here, this again with reference to the above stated international patent applications. Cover 1 is also the air piston, and together with the base part (the air cylinder) forms an air chamber 19 in which air can be compressed. In an alternative embodiment the air piston is connected fixedly as separate element to the peripheral wall of the cover. In the exemplary embodiment of FIG. 3 the cover 1 is still provided with a peripheral protruding edge 20 on its inner wall, which served as seating for the dish-shaped air inlet valve of the earlier version of the dispenser. This protruding edge 20 can now in fact be dispensed with. The air inlet valve is now formed by annular element 9 which has as seating the inner wall of cover 1 close to or, more precisely, around air inlet opening 12.

The present invention is not limited to the embodiment shown in the drawings. It is thus possible for instance to arrange the air inlet opening at other positions in cover 1. The air inlet opening is preferably provided in an upright wall, so that the chance of water entering via this opening is minimized. It is however also possible to use the chimney-like openings 21 shown in the figures, which are preferably covered by the cover member to prevent water entering the dispenser. In that case the annular element will extend over these openings 21 on the inside of the upper wall of cover 1 in which they are arranged.

FIGS. 4-15 show four other examples of a dispenser according to the present invention. Components corresponding with the components of the dispenser shown in FIGS. 1-3 are designated with the same reference numerals. As can be seen in the figures, the appearance of the dispenser is the same in each case. The difference between the different examples lies in particular in the embodiment of the supply-closing means for closing the air supply to the air pump and the position of these supply-closing means in the cover.

The dispenser comprises cover 1, which is provided with spout-like dispensing part 2 and casing 3, a cover member 17 and a base part 22. Base part 22 is provided with internal screw thread to enable the dispenser to be screwed onto the neck of a liquid container. Air cylinder 23 and liquid cylinder 24 are integrated into base part 22. A liquid piston 25 is axially displaceable in reciprocal manner in liquid cylinder 24. Liquid piston 25 is snapped fixedly into insert 10, which is in turn snapped fixedly onto an inward-lying peripheral edge 26 of cover 1. Base part 22 is further provided on its underside with a core part 27 for connection of a liquid hose which protrudes into the liquid container for coupling to the dispenser. The core part is provided internally with a protruding edge 28 with which a hook-like outer end 29 of an elongate element 30 co-acts. Together with the internal protruding edge 28, elongate element 30 also forms a liquid inlet valve. The internal protruding edge 28 herein forms the seating, while edge part 31 forms the valve part. Together with an internal protruding edge 32 of liquid piston 25 the other outer end of elongate member 30 forms a seal. This seal is particularly intended to prevent liquid flowing outside from the liquid container via liquid pump 24, 25 through dispensing part 2 during transport of the dispenser. A compression spring 33 is further arranged between base part 22 on one side and the moving assembly of casing 3, insert 10 and liquid piston 25. This compression spring 33 provides for resetting of assembly 1,10,25 after it has been pressed in and released. During this return stroke liquid is drawn into liquid chamber 34 and air into air chamber 19 of respectively the liquid pump and air pump. In the subsequent downward stroke the chambers 19,34 will be made smaller and the fluid received therein will be compressed to a greater or lesser extent.

On the top side of liquid piston 25 a float element 35 is accommodated loosely in the dispenser. This float element 35 forms together with upper edge 36 of liquid piston 25 a pressure valve for the liquid pump. With a sufficient pressure build-up in liquid chamber 34, float element 35 will move upward relative to liquid piston 25 and leave clear the passage for liquid to mixing chamber 37. When the pressure build-up in liquid chamber 34 has fallen to a determined level, passage of liquid to mixing chamber 37 will be closed under the own weight of float element 35. In mixing chamber 37 the liquid is mixed with the air coming from the air pump. The air leaves air chamber 19 via pressure valve 18 for air. In the return stroke of assembly 1,10,25 the air is drawn into air chamber 19 via air inlet opening 12 and an open suction valve. The suction valve for air is formed by the bottom edge 38 of an annular element 40. The bottom edge 38 of annular element 40 is flexible relative to the remaining part of this annular element 40. Annular element 40 consists substantially of a first wall part which is in full contact with the inner wall of casing 3 of cover 1 and which carries flexible valve part 38, as well as a wall part 39 extending radially inward. This wall part 39 supports on the upper edge of the outer casing of insert 10. Air chamber 19 is bounded by air cylinder 22 and the air piston. Air inlet opening 12 in casing 3 of cover 1 debouches directly into air chamber 19. Air inlet opening 12 is closed at least by the flexible bottom edge 38 of annular element 40. In the case of underpressure in air chamber 19, bottom edge 38 of annular element 40 will be released from the inner wall of casing 3 and air will be able to flow into air chamber 19 via air inlet opening 12.

Figure 7:
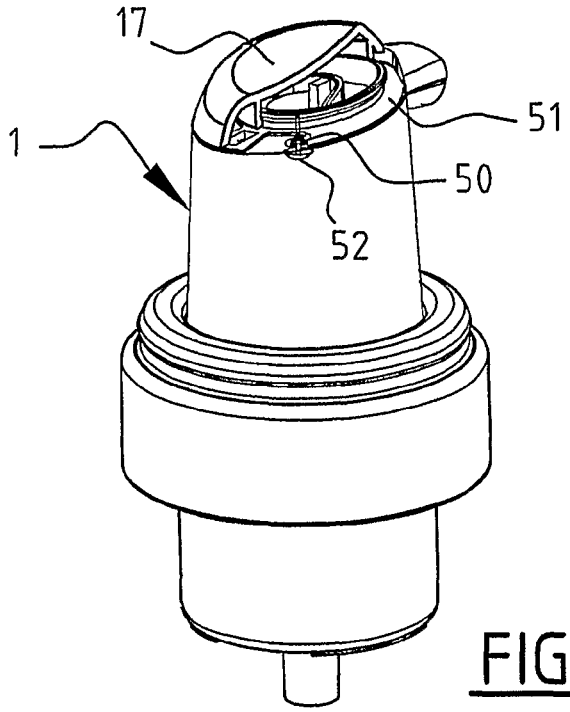
FIGS. 7-9 show yet another example of a dispenser shown respectively in perspective, cross-section and with exploded parts.
Figure 8:
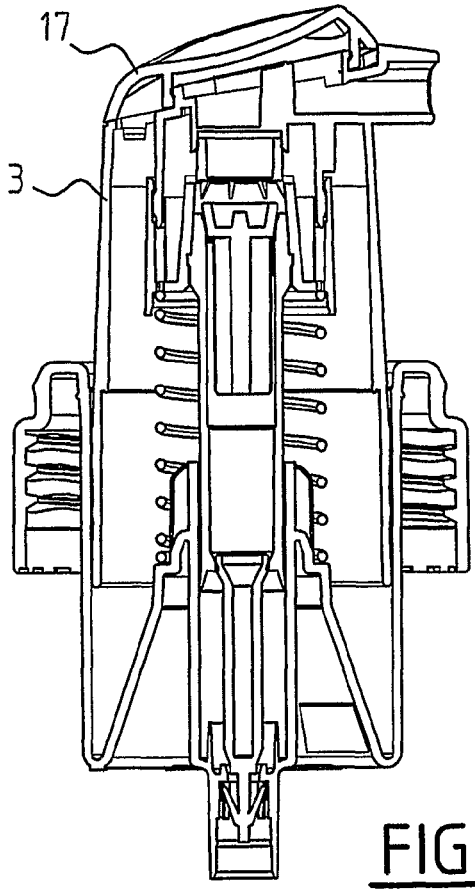
Figure 9:
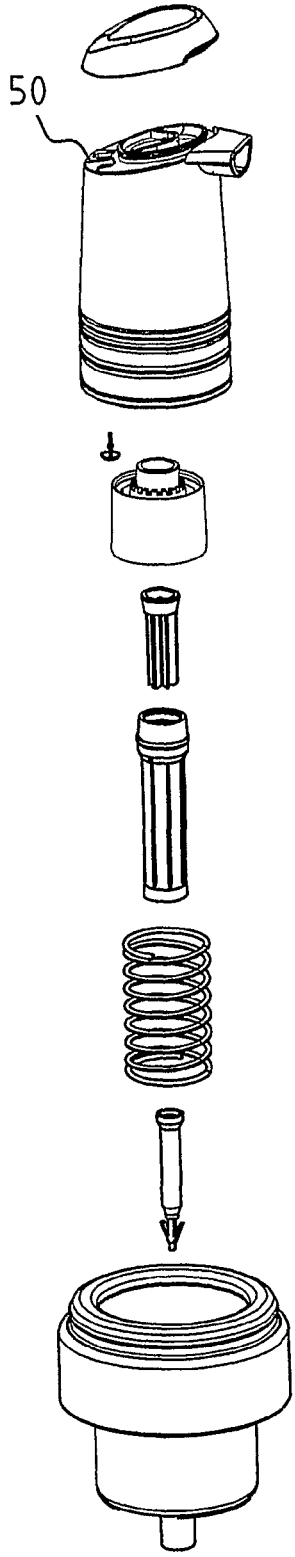

In FIGS. 7-9 is shown yet another example of a dispenser according to the invention. Air inlet opening 50 is here provided in upper wall 51 of cover 1. The supply-closing means in the form of a toadstool-shaped valve part 52 once again lie against the wall around air inlet opening 50. A cover member 17 is placed over upper wall 51 of cover 1. Cover member 17 is snapped fixedly onto the top side of cover 1. Between cover member 17 and casing 3 of the cover is provided a gap-like opening for admitting air from the environment to air inlet opening 50. Reference is otherwise made to the construction of the description relating to FIGS. 4-6.

Figure 10:
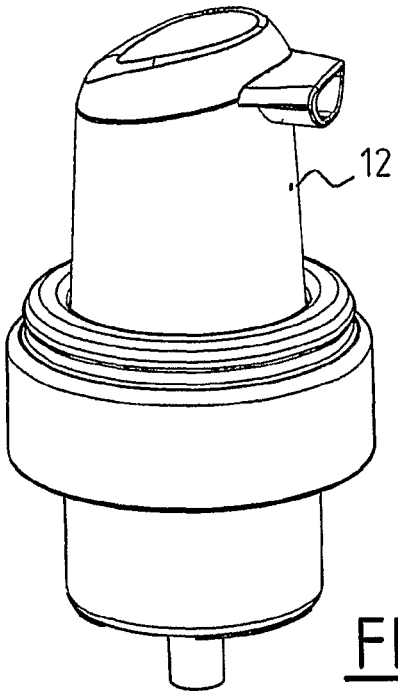
FIGS. 10-12 show yet another example of a dispenser shown respectively in perspective, cross-section and with exploded parts.
Figure 11:
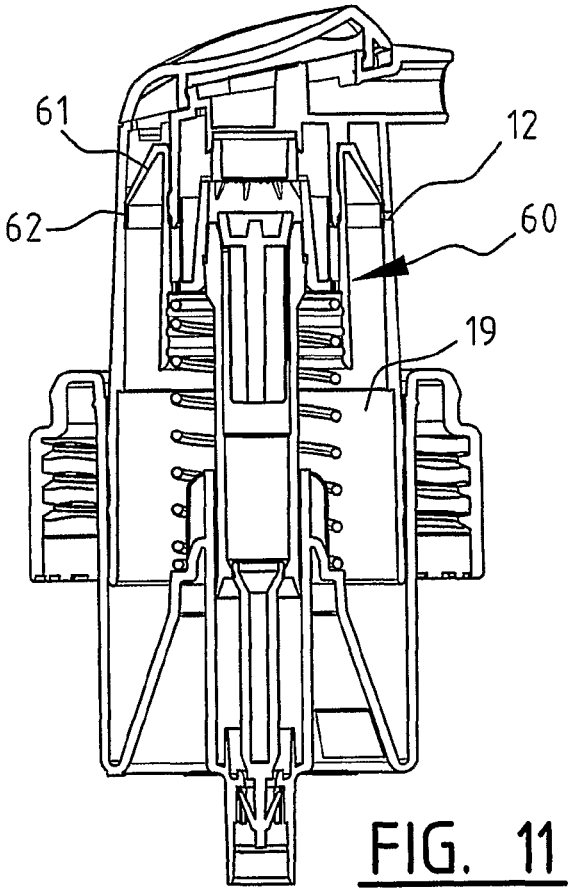
Figure 12:
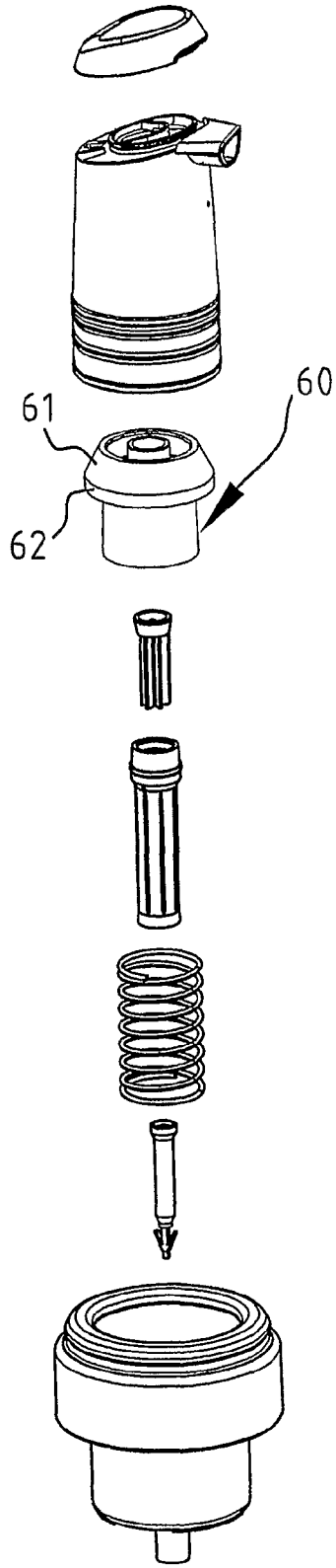

In yet another example according to FIGS. 10-12 the annular element is embodied integrally with insert 60. On its upper end the insert 60 has an overhanging wall part 61 which comprises a bottom edge which is in contact with the inner wall around air inlet opening 12. The bottom edge 62 and/or overhanging wall part 61 take a flexible form such that the supply for air via air inlet opening 12 is left clear at a predetermined pressure difference between air chamber 19 and the environment.

Figure 13:
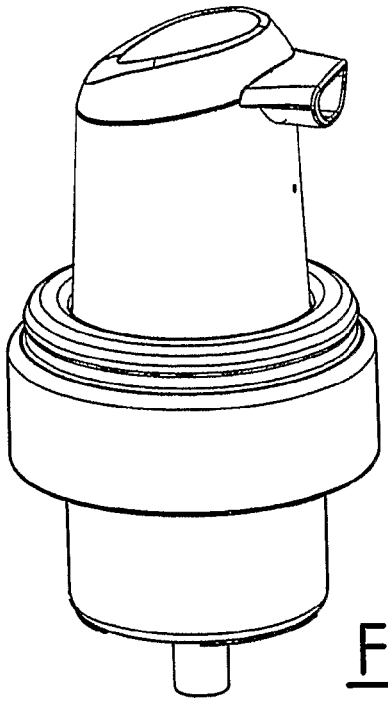
FIGS. 13-15 show a final example of a dispenser shown respectively in perspective, cross-section and with exploded parts.
Figure 14:
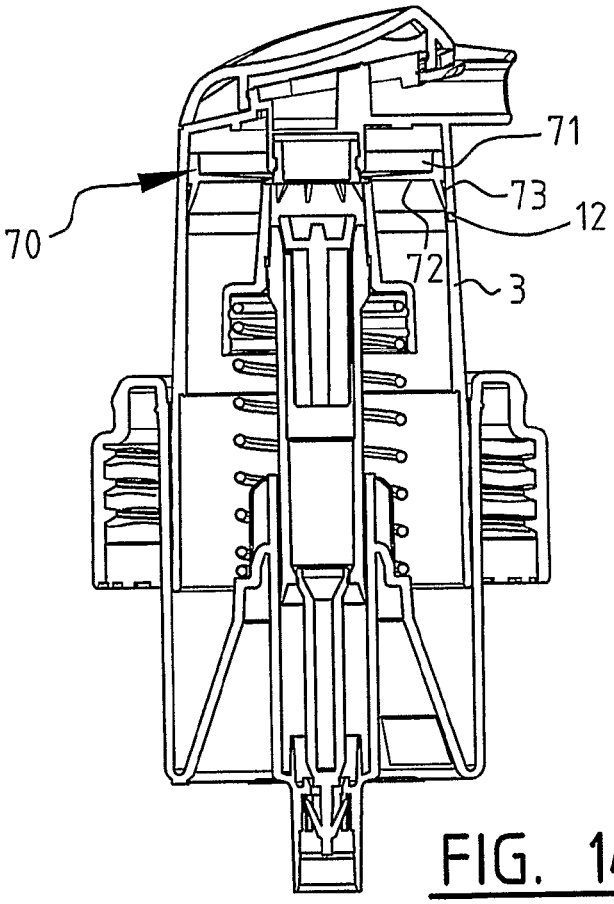
Figure 15:
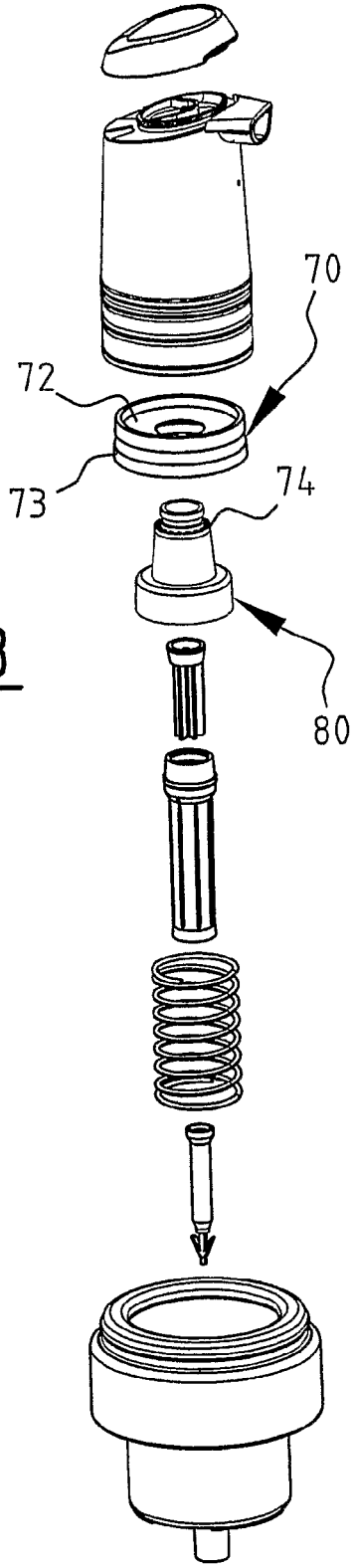

Finally, FIGS. 13-15 show a last example. The supply-closing means and the discharge-closing means for air are here integrated into one and the same annular element 70. Annular element 70 comprises a base 71 which lies against the inner wall of casing 3. A first wall part 72 and a substantially axially extending wall part 73 extend radially inward from base 71. The first wall part forms a valve part which, together with a peripheral edge 74 of insert 80, forms a pressure valve of the air pump. Second wall part 73 has a lower edge which lies against the inner wall of casing 3. This lower edge forms the valve part, wherein the inner wall around air inlet opening 12 forms a seating for this valve part. Together they form the suction valve of the air pump. Wall parts 72, 73 are at least partially flexible, i.e. at their outer ends, relative to the associated seatings. The construction and the manner of functioning are otherwise the same as the above described exemplary embodiments.

The shape and size of the air chamber can be modified as desired.

The invention claimed is:

1. A dispenser for a liquid container, comprising:

a liquid pump with a liquid cylinder and a liquid piston displaceable axially in the liquid cylinder, an air pump with an air cylinder and an air piston axially displaceable in the air cylinder, an air chamber defined between the air cylinder and the air piston, a supply-closing element for closing the air supply to the air pump, wherein the supply-closing element comprises an annular element, a discharge-closing element for closing the air discharge from the air pump, a cover having casing, wherein the cover is connected to the air piston; and an air inlet opening in the casing of the cover, wherein the air inlet opening debouches directly into the air chamber, wherein the annular element of the supply-closing element comprises an edge part extending obliquely downward toward a vertical inner wall of the cover and in contact with the vertical inner wall of the cover.

2. The dispenser as claimed in claim 1, wherein the cover together with the air cylinder forms the air chamber in which air can be compressed.

3. The dispenser as claimed in claim 1, wherein an underside of the casing of the cover is the air piston for the air pump.

4. The dispenser as claimed in claim 1, wherein at least the edge part of the annular element is flexible relative to the part of the inner wall of the cover.

5. The dispenser as claimed in claim 1, wherein the discharge-closing element is integrated with the annular element of the supply-closing.

6. The dispenser as claimed in claim 1, further comprising an insert, wherein the insert is connected to the cover and comprises a mixing chamber for mixing air from the air pump and liquid from the liquid pump.

7. The dispenser as claimed in claim 6, wherein the annular element is integrated with the insert.

8. The dispenser as claimed in claim 1, wherein the cover comprises an upper wall and a peripheral wall, wherein a free lower part of the peripheral wall is the air piston.

9. The dispenser as claimed in claim 8, wherein the air inlet opening is provided in the peripheral wall.

10. The dispenser as claimed in claim 8, wherein the air inlet opening is provided in the upper wall.

11. The dispenser as claimed in claim 10, wherein a cover member is placed over the upper wall and a further air inlet opening is provided between the cover and the cover member.

12. The dispenser as claimed in claim 11, wherein the edge part of the annular element of the supply-closing element comprises a valve which extends around the air inlet opening in the upper wall of the cover.

13. A dispensing assembly comprising a liquid container and a dispenser as claimed in claim 1.

14. A method of dispensing a mixture of a liquid and air, comprising:

mixing a liquid and air using a dispenser for a liquid container to form a mixture of the liquid and air; and dispensing the mixture from the dispenser, wherein the dispenser for a liquid container, comprises:

a liquid pump with a liquid cylinder and a liquid piston displaceable axially in the liquid cylinder, an air pump with an air cylinder and an air piston axially displaceable in the air cylinder, an air chamber defined between the air cylinder and the air piston, a supply-closing element for closing the air supply to the air pump, wherein the supply-closing means comprises an annular element, a discharge-closing element for closing the air discharge from the air pump, a cover having casing and an axially inward-lying peripheral edge to which the liquid piston is connected, wherein the cover is connected to the air piston, and an air inlet opening in the casing of the cover, wherein the air inlet opening debouches directly into the air chamber, wherein the annular element of the supply-closing element comprises an edge part extending obliquely downward toward a vertical inner wall of the cover and in contact with the vertical inner wall of the cover.

15. The method as claimed in claim 14, wherein at least the edge part of the annular element is flexible relative to the part of the inner wall of the cover located around the air inlet opening.

16. The method as claimed in claim 14, wherein the mixture is a foam.

17. The method as claimed in claim 14, further comprising:

pumping liquid from the liquid pump into a mixing chamber;

pumping air from the air pump into the mixing chamber; and mixing the liquid and the air in the mixing chamber, wherein the dispenser further comprises an insert, wherein the insert is connected to the cover and comprises the mixing chamber for mixing the air from the air pump and the liquid from the liquid pump.

18. The method as claimed in claim 17, wherein the annular element is integrated with the insert.

* * * * *